US005555874A

United States Patent [19]

Savage

[11] Patent Number: 5,555,874

[45] Date of Patent: Sep. 17, 1996

[54] WAIST SUPPORTED BOW STRING STEADYING DEVICE FOR ARCHER

[75] Inventor: Huey P. Savage, Lake Forest, Calif.

[73] Assignee: Savage Systems, Inc., Oak Grove, La.

[21] Appl. No.: 321,746

[22] Filed: Oct. 12, 1994

[51] Int. Cl.[6] ..... F41B 5/20

[52] U.S. Cl. ..... 124/1; 124/86; 124/89

[58] Field of Search ..... 124/1, 23.1, 86, 124/88, 89; 441/88, 91, 106–109, 119

[56] References Cited

U.S. PATENT DOCUMENTS

| | | | |
|---|---|---|---|
| 1,275,647 | 8/1918 | Bjerre | 441/91 |
| 1,368,529 | 2/1921 | Williams | 441/108 |
| 1,394,180 | 10/1921 | Lundin | 441/106 |
| 2,094,499 | 8/1937 | Scavo | 441/91 |
| 2,292,490 | 8/1942 | Stokes | 441/109 |
| 3,416,172 | 12/1968 | Gerling | 441/108 |
| 4,674,472 | 6/1987 | Reis | 124/89 |
| 5,351,867 | 10/1994 | Vest | 124/89 X |

FOREIGN PATENT DOCUMENTS

| | | | |
|---|---|---|---|
| 347569 | 3/1905 | France | 441/91 |

*Primary Examiner*—Eric K. Nicholson
*Assistant Examiner*—John A. Ricci
*Attorney, Agent, or Firm*—Roy A. Ekstrand

[57] ABSTRACT

A waist supported bow string steadying device for an archer includes a fabric envelope within which a resilient bladder is supported to provide a size variable somewhat resilient member for contact with the bow string of a drawn bow prior to release. In several embodiments, the resilient member includes an inflatable bladder having a captive air volume therein which inflates to various degrees to provide bow string arrow rests of varying sizes. In alternate embodiments, a portion of the steadying device is provided with a storage cavity in which articles of convenience may be stored. In still further embodiments, the interior of the fabric envelope is provided with one or more resilient foam pads to impart shape and size to the fabric envelope and the desired dimension to the bow string steadying device.

17 Claims, 2 Drawing Sheets

WAIST SUPPORTED BOW STRING STEADYING DEVICE FOR ARCHER

FIELD OF THE INVENTION

This invention relates generally to archery apparatus and particularly to apparatus for assisting the archer in steadying the bow at the moment of arrow release.

BACKGROUND OF THE INVENTION

Archery has continued to increase in popularity as a sport and recreational activity for both target shooting and hunting. The apparatus used in archery has been continuously developed to a substantial level of sophistication. Increased power and accuracy of archery apparatus has been achieved as practitioners have developed a variety of stronger and more powerful types of bows. One of the most powerful type of bows developed has been that generally referred to as a compound bow. In a typical compound bow, an elongated rigid riser defines a handle grip and supports a pair of extending flexible resilient limbs at opposed ends. The outer ends of each limb support a rotatable eccentric wheel or cam to which a pair of cables and a bow string are secured. An arrow rest is supported upon the riser to support the forward portion of the arrow shaft as the bow is drawn and aimed.

While arrows initially were formed of simple wooden shafts having feather fletchings and fixed arrow heads or points, modern arrows are usually formed of hollow aluminum alloy shafts or composite materials having threaded inserts at the forward end for installing removable points or heads. The remaining end of the arrow shaft typically supports a molded plastic arrow nock which defines a slot for engaging the bow string. The arrow fletchings are most commonly formed of plastic vanes or the like.

The shooting operation is carried forward as the archer selects an arrow and fits the hock to the bow string at a point referred to as the hocking point. The shaft of the arrow is rested upon the arrow rest as the arrow hock and bow string are drawn back flexing the bow limbs and rotating the eccentric wheels to store energy in the bow. Once the bow is drawn, the nocking point on the bow string and the arrow rest define an axis known as the shooting axis along which the arrow is launched once the drawn bow string is released.

Regardless of the different shooting techniques used by various archers, the moments in the shooting operation in which the drawn bow is aimed at the target are the most critical moments in determining the accuracy of the archer. While a number of devices have been provided by practitioners in the art for assisting the archer in maintaining a steady bow position during the final moments prior to arrow release, difficulty in maintaining a steady bow position often plagues even the most experienced of archers.

Despite the advances in archery apparatus directed toward assisting the archer in maintaining a steady bow during aiming and arrow release, there remains nonetheless a continuing need in the art for evermore improved and effective apparatus for achieving a steady aim during the critical moments prior to arrow release.

SUMMARY OF THE INVENTION

Accordingly, it is a general object of the present invention to provide an improved archery apparatus for steadying an archer's bow prior to arrow release. It is a more particular object of the present invention to provide an improved archery apparatus which interacts with the bow string of a drawn bow to aid the archer in steadying the bow prior to arrow release.

In accordance with the present invention, there is provided for use in steadying an archery bow having a bow string, a steadying device comprises: an outer envelope having an interior cavity and a front surface; means for securing the fabric envelope to an archer's waist; and resilient means received within the outer envelope for resiliently supporting the front surface, the steadying device being worn by an archer proximate the archer's hip such that the front surface extends outwardly and provides a resilient surface against which an archer may press a portion of a drawn bow string to steady a drawn bow.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
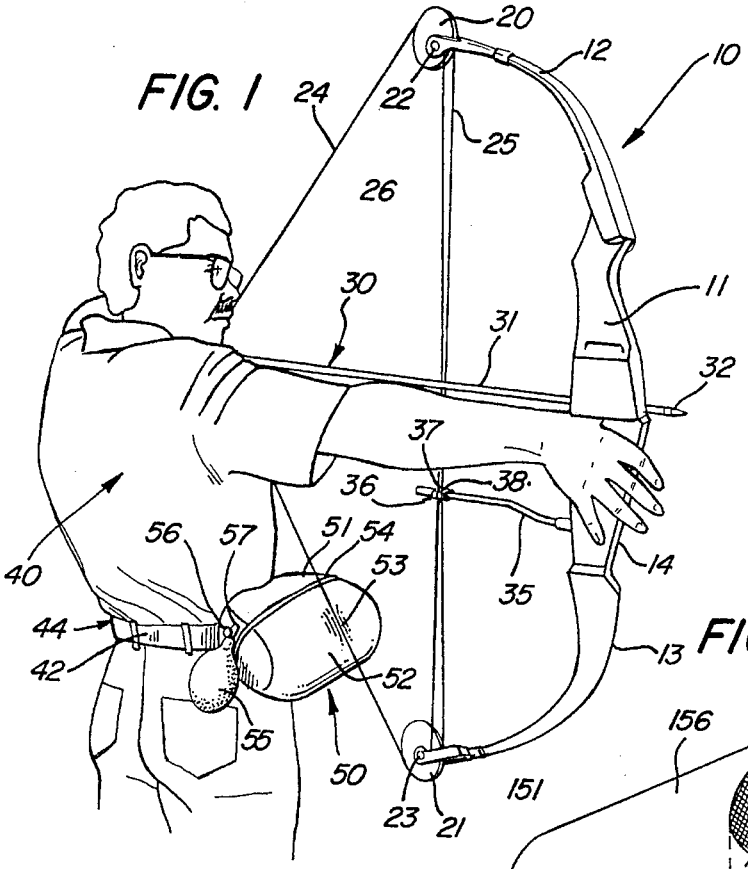
FIG. 1 sets forth a perspective view of a typical archer and bow utilizing a waist supported bow string steadying device constructed in accordance with the present invention.

FIG. 1 sets forth a perspective view of a typical archer generally referenced by numeral 40 utilizing a compound bow 10 in combination with the present invention waist supported bow string steadying device generally referenced by numeral 50. Compound bow 10 is constructed in accordance with conventional fabrication techniques and includes a generally rigid riser 11 defining a grip 14 and an arrow rest (not seen). Compound bow 10 further includes a pair of flexible resilient limbs 12 and 13 each supporting an eccentric wheel 20 and 21 respectively at the outer ends thereof. A pair of shafts 22 and 23 rotatably support eccentric wheels 20 and 21. A pair of cables 25 and 26 are coupled to eccentric wheels 20 and 21 in accordance with conventional fabrication techniques. A bow string 24 extends between eccentric wheels 20 and 21 in accordance with conventional fabrication techniques. Compound bow 10 further includes an elongated cable guard 35 supported by riser 11 and having a slidably movable cable guide 36 received upon cable guard 35 and having a pair of cable slots 37 and 38 formed therein. Slots 37 and 38 receive cables 25 and 26 in accordance with conventional fabrication techniques. An arrow 30 having an elongated shaft 31 and an arrow point 32 also constructed in accordance with conventional fabrication techniques is shown coupled to bow string 24 and resting upon the arrow rest (not seen) of compound bow 10.

In the position shown, archer 40 has drawn arrow 30 and bow string 24 bending limbs 12 and 13 and rotating eccentric wheels 20 and 21 to store energy within bow 10 in preparation for launching arrow 30. The moment depicted in FIG. 1 corresponds to the final aiming moments in which the steady control of the bow is critical in achieving accurate shooting.

In accordance with the present invention, steadying device 50 is received and supported upon belt 42 encircling waist 41 of archer 40. Steadying device 50 is positioned at the approximate hip location of archer 40 and extends toward bow string 24. Steadying device 50 is described below in greater detail. However, suffice it to note here that in accordance with the present invention, steadying device 50 defines a resilient fabric layer 51 having a frontal surface 52, a seam 54 and as is better seen in FIG. 3 an elastic bladder 58 supported within fabric layer 51. In further accordance with the present invention, a resilient bulb 55 having a conventional valve 56 coupled thereto is coupled to bladder 58 within fabric layer 51 by a flexible tube 57. In its preferred form, resilient bulb 55 and valve 56 are fabricated in accordance with conventional fabrication techniques used in providing a convenient hand actuated air pump used in apparatus such as a blood pressure testing device or the like.

In further accordance with the present invention, steadying device 50 has been inflated using resilient bulb 55 and valve 56 to expand fabric layer 51 and bladder 58 to position frontal surface 52 at the desired distance from waist 41 of archer 40. The resilient structure steadying device 50 provided by the inflated internal bladder and resilient fabric layer surrounding it provides a front surface 52 which when pressed by bow string 24 in the manner shown in FIG. 1 deforms inwardly forming a bow string impression 53. The degree of bow string impression resulting from archer 40 holding bow string 24 against front surface 52 varies with user preference and is controlled by the degree of inflation of bladder 58 (seen in FIG. 3).

In accordance with an important aspect of the present invention, archer 40 is able to utilize the contact between bow string 24 and steadying device 50 to provide a controlling contact between the archer and bow string 24 which aids in maintaining the steady position of compound bow 10 at the critical moments directly preceding arrow release or launch. It will be recognized by those skilled in the art that different archers having different shooting styles and different physiology as well as utilizing a variety of bow structures will require different degrees of inflation of steadying device 50. Thus, in its preferred form, steadying device 50 is fabricated of sufficiently resilient material and a sufficiently expandable interior bladder to assume a wide range of dimensions as the degree of bladder inflation is varied. To achieve a greater degree of dimensional control and stability, steadying device 50 may be fabricated using a resilient fabric layer 51 which exhibits a greater elasticity in the portion forming front surface 52 and a lesser degree of elasticity in the portion resting against the archer's torso. In such case, a seam 54 is formed to join the two different resilient fabric materials.

Figure 2:
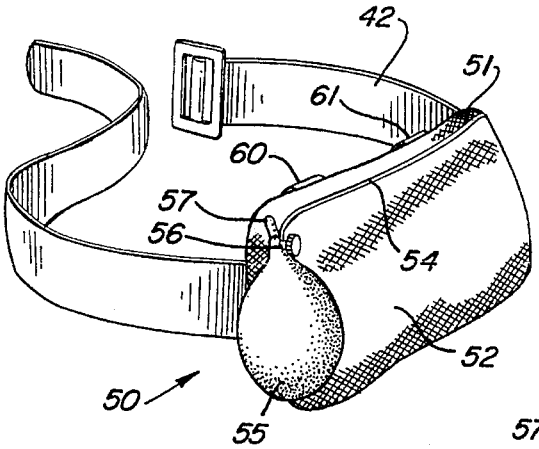
FIG. 2 sets forth a perspective view of the present invention waist supported bow string steadying device in a relaxed position.
Figure 3:
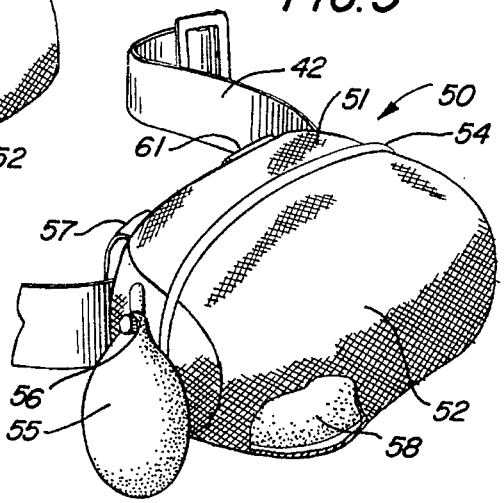
FIG. 3 sets forth a partial perspective view of the present invention waist supported bow string steadying device in the inflated or extended position.

FIG. 2 sets forth a perspective view of steadying device 50 in the compacted or relaxed position in which bladder 58 (seen in FIG. 3) has been virtually entirely deflated. More specifically, steadying device 50 includes a resilient fabric outer layer 51 having a seam 54 formed therein and defining a front surface 52. Steadying device 50 further includes a pair of belt loops 60 and 61 on the rear surface thereof which receive a conventional belt 42. Alternatively, belt 42 may be secured directly to the rear surface of fabric layer 51 without departing from the spirit and scope of the present invention. As described above, fabric layer 51 is preferably formed of a resilient expandable material such as spandex or the like to facilitate substantial dimensional change during the above-described inflation. As is seen in FIG. 3, an inflatable bladder 58 is received within the interior of fabric layer 51 and is coupled to a resilient bulb 55 by a flexible tube 57. A conventional valve 56 is provided between tube 57 and bulb 55 to facilitate the inflation and deflation of bladder 58 (seen in FIG. 3). In its compacted state as shown in FIG. 2, steadying device 50 may be worn without imposing substantial inconvenience or difficulty upon the wearer during periods between shooting.

FIG. 3 sets forth the present invention steadying device in the fully inflated configuration. As can be seen, steadying device 50 having fabric layer 51, seam 54 and frontal surface 52 formed therein surrounds inflated bladder 58 and is substantially expanded from the noninflated position shown in FIG. 2. Bulb 55, valve 56 and tube 57 are coupled to bladder 58 in accordance with conventional fabrication techniques by which bulb 55 may be utilized to inflate or deflate bladder 58 to expand or contract steadying device 50. Belt loops 60 and 61 secure fabric layer 51 to belt 42.

Figure 4:
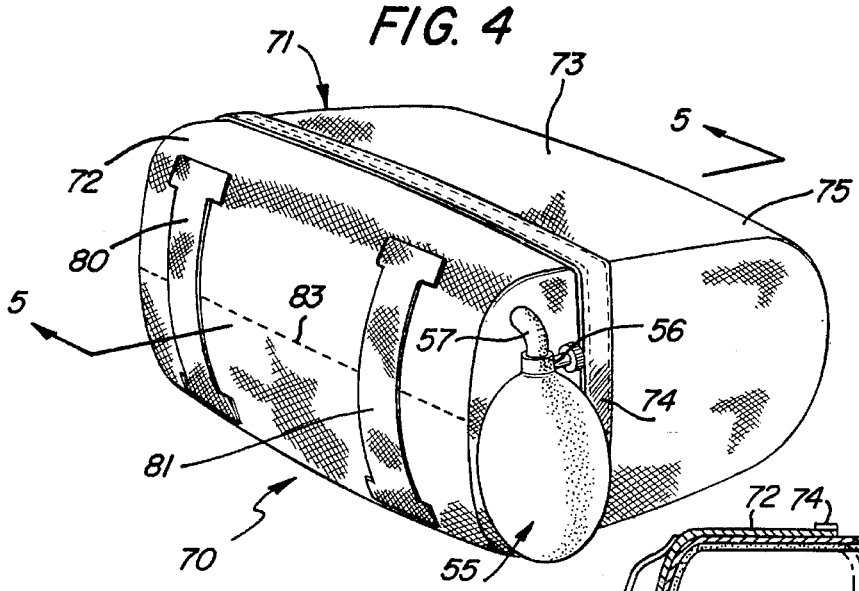
FIG. 4 sets forth a perspective view of an alternate embodiment of the present invention waist supported bow string steadying device in its extended position.

FIG. 4 sets forth a perspective view of an alternate embodiment of the present invention bow string steadying device generally referenced by numeral 70. Steadying device 70 includes a fabric envelope 71 formed of a flexible portion 72 and a resilient portion 73 joined by a binder strip 74. In its preferred form, flexible portion 72 is formed of a non-expanding material such as canvas or the like while resilient portion 73 is formed of a material which undergoes a high degree of expansion such as spandex or the like. Binder 74 provides a sewn seam structure which securely joins flexible portion 72 to resilient portion 73. Resilient portion 73 defines a front surface 75 which as described above provides a resilient steadying surface for bow string 24 (seen in FIG. 1). A pair of belt loops 80 and 81 are secured to the rear surface of flexible portion 72 and are preferably formed of a nonresilient material such as canvas or the like. As is better seen in FIG. 5, steadying device 70 includes an internal expandable bladder 82 preferably formed of a material such as rubber or the like which is coupled to a tube 57 extending through a convenient aperture in flexible portion 72. A bulb 55 and valve 56 constructed in accordance with conventional fabrication techniques is coupled to tube 57 for providing inflation and deflation of bladder 82 (seen in FIG. 5).

In the expanded position shown in FIG. 4, the interior bladder of steadying device 70 has been inflated using bulb 55 and is maintained in an inflated condition by closing valve 56. The inflation of the interior bladder within fabric envelope 71 causes resilient portion 73 to expand outwardly from binder 74. Thus, the outward dimension or degree of expansion of resilient portion 73 is determined by the pressure or the degree of inflation of the internal bladder. As a result, the user is able to control the outward dimension of resilient portion 73 and position front surface 75 at the desired distance to suit the archer's style, physiology and equipment. Once steadying device 70 is no longer to be used, valve 56 is opened releasing the pressure within the interior bladder of steadying device 70 and permitting resilient portion 73 to contract.

Figure 5:
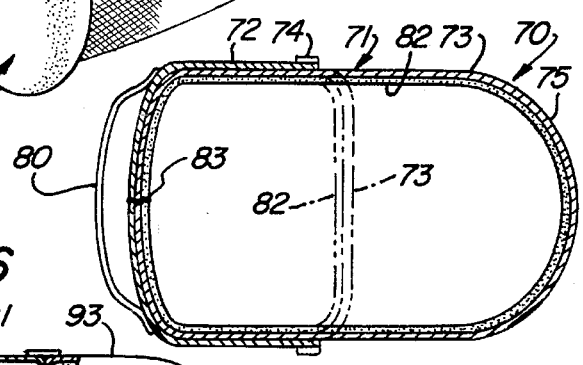
FIG. 5 sets forth a section view of the alternate embodiment of the present invention waist supported bow string steadying device taken along section lines 5—5 in FIG. 4.

FIG. 5 sets forth a section view of steadying device 70 taken along section lines 5—5 in FIG. 4. As described above, steadying device 70 includes a fabric envelope 71 formed of a flexible nonexpanding portion 72 and a resilient expandable portion 73 joined by a binder seam 74. A pair of belt loops 80 and 81 (the latter seen in FIG. 4) are secured to flexible portion 72. Resilient portion 73 extends, in its preferred fabrication, beneath flexible portion 72 and is secured to flexible portion 72 at a sewn seam 83. An inflatable bladder 82 formed of a rubber material or the like is received within resilient portion 73 and as described above is coupled to bulb 55 and valve 56 by a flexible tube 57. In the position shown in solid-line representation in FIG. 5, bladder 82 has been inflated to a substantial degree extending front surface 75 outwardly a substantial distance. In the event, however, bladder 82 is deflated, the resilient structures of bladder 82 and resilient portion 73 cause contractions thereof and change the degree of extension of front surface 75. For example, the positions of resilient portion 73 and bladder 82 are shown alternatively in dashed-line configuration at a substantially contracted position which results from partial deflation of bladder 82. Between the dashed-line positions shown in FIG. 5 and the solid-line fully extended position shown in FIG. 5, intermediate positions are readily obtainable by simply inflating bladder 82 as desired. Thus, in accordance with an important aspect of the present invention, the extension of front surface 75 from the wearer's hip may be adjusted to suit the needs of a wide variety of archers. It will be apparent to those skilled in the art that the entire structure of steadying device 70 may be completely deflated and may thereafter be conveniently folded or compacted for easy storage or convenient wearing during periods of nonuse.

Figure 6:
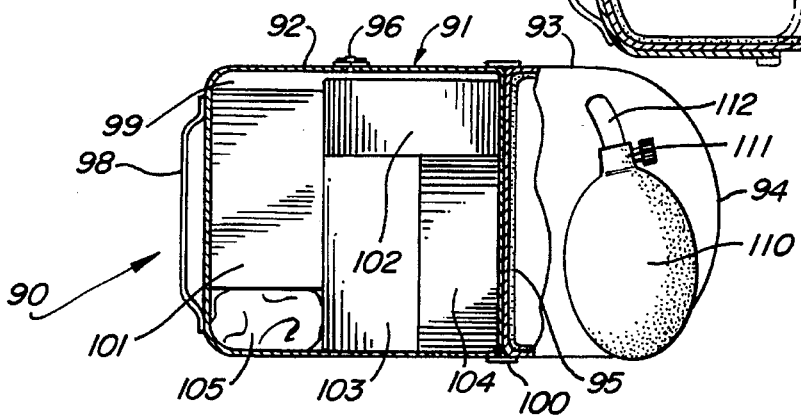
FIG. 6 sets forth a partially sectioned side view of a further alternate embodiment of the present invention waist supported bow string steadying device.

FIG. 6 sets forth a partially sectioned view of a further alternate embodiment of the present invention bow string steadying device generally referenced by numeral 90. Steadying device 90 includes a fabric envelope 91 having a rear portion 92 formed of a flexible material and defining an interior cavity 99. A belt loop 98 is secured to the rear surface of rear portion 92. An elongated zipper 96 provides a closeable opening in rear portion 92 providing access to interior cavity 99. A plurality of articles 101 through 105 are conveniently stored within interior cavity 99 of rear portion 92. Steadying device 90 further includes a resilient portion 93 secured to rear portion 92. A binding 100 extends between rear portion 92 and resilient portion 93 to provide secure attachment therebetween. An inflatable bladder 95 preferably formed of a rubber material or the like is received within resilient portion 93. A conventional inflating bulb 110 having a valve 111 is coupled to bladder 95 by a flexible tube 92.

Steadying device 90 is worn upon the archer's hip in the manner shown in FIG. 1 for steadying device 50. Steadying device 90 differs from the above-described embodiments in that it provides an inflatable expanding portion having a front surface 94 for bow string contact and steadying together with a rear portion having an interior cavity for convenient storage of various articles. Bulb 110 and valve 111 may be utilized in the manner described above to inflate bladder 95 and expand resilient portion 93 to the extent desired to provide the position of front surface 94 which meets the user's needs in steadying the bow string during shooting. The added advantage of providing article storage is provided by using zipper 96 to gain access to interior cavity 99. It will be recognized by those skilled in the art that the relative sizes of interior cavity 99 dedicated to material storage and resilient portion 93 accommodating bladder 95 may be varied to suit the user's preference without departing from the spirit and scope of the present invention.

Figure 7:
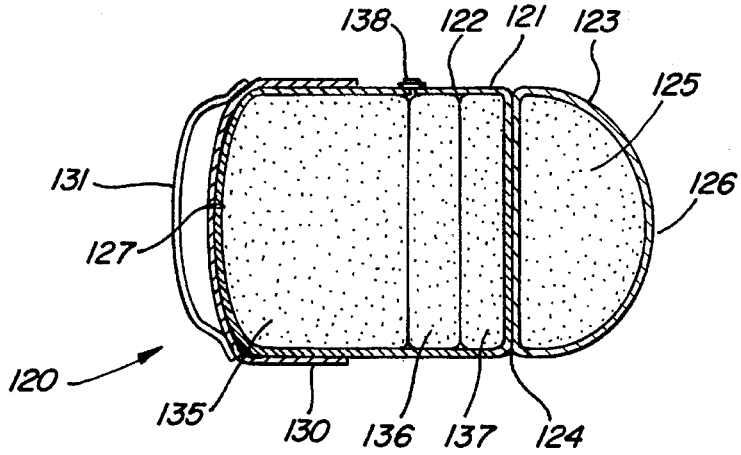
FIG. 7 sets forth a section view of a still further alternate embodiment of the present invention waist supported bow string steadying device.

FIG. 7 sets forth a section view of a still further alternate embodiment of the present invention bow string steadying device generally referenced by numeral 120. Steadying device 120 includes a resilient expandable fabric envelope 121 formed of a rear portion 122 and a front portion 123 joined along a common junction 124. Steadying device 120 further includes an outer layer 130 secured to the rear surface of rear portion 122 by a sewn seam 127. A belt loop 131 is secured to the rear portion of outer layer 130. Rear portion 122 further defines an elongated zipper 138 which provides access to the interior of rear portion 122. A resilient foam pad 125 is enclosed within front portion 123 and provides resilient support for front surface 126 of portion 123. A plurality of foam inserts preferably formed of a resilient material or other lightweight foam 135, 136 and 137 are received within rear portion 122 of fabric envelope 121 through zipper 138.

In accordance with the embodiment of FIG. 7, bow string steadying device 120 may be worn upon the archer's hip in the same manner set forth above in FIG. 1 for steadying device 50. In such case, front surface 126 provides a resilient bow string steadying surface in the manner described above. The degree of extension of steadying device 120 from the user's hip may be adjusted by varying the number of foam inserts within rear portion 122. Thus, with foam inserts 135, 136 and 137 in place, front surface 126 is maximally extended from the user's hip. A lesser extension is obtained by the user simply removing one of the foam inserts from rear portion 122. In such case, the resilient fabric of rear portion 122 contracts reducing the overall extension of steadying device 120. It will be apparent that removal of both inserts 136 and 137 permits rear portion 122 to further contract and further reduces the extension of front surface 126. Alternatively, the user may remove foam insert 135 and utilize the interior of rear portion 122 for convenient article storage in a manner similar to that set forth above in FIG. 6.

Figure 8:
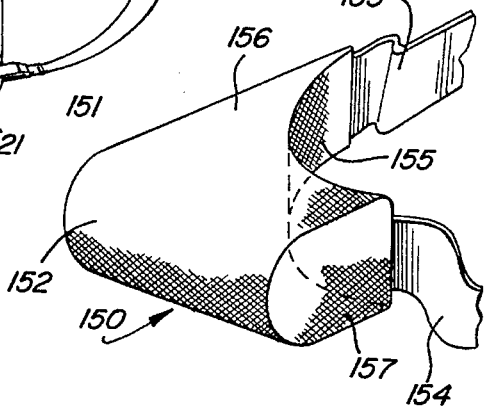
FIG. 8 sets forth a perspective view of a still further alternate embodiment of the present invention.

FIG. 8 sets forth a perspective view of a still further alternate embodiment of the present invention steadying device generally referenced by numeral 150. Steadying device 150 is preferably formed of a resilient foam material such as closed or open cell rubber or plastic or its equivalent. Steadying device 150 defines a body 151 having a generally cylindrical front surface 152 and generally planar side surfaces. Body 151 further defines a curved body surface 155 which is nonsymmetrically positioned upon body 151. As a result, body surface 155 generally conforms to the torso of the archer wearing steadying device 150 which is secured to the archer's torso by a pair of flexible belts 154 and 153. Belts 154 and 153 are shown truncated in FIG. 8 but should be understood to include conventional fastening elements suitable for securing the belts about the archer's torso in the manner set forth above. Steadying device 150 may be worn having long side 156 positioned about the back portion of the archer's torso and short side 157 along the front portion of the archer's torso or, if preferred, the position of steadying device 150 may be inverted by simply rotating body 151 and belts 153 and 154 and refastening the device to the archer's torso such that long side 156 extends along the front portion of the archer's torso with side 157 along the rear portion of the archer's torso. The important aspect of steadying device 150 is the provision of the resilient body portion of body 151 beneath curved surface 152 for steadying the bow string in the manner described above and shown particularly in FIG. 1. Thus, the user is able to secure steadying device 150 to the user's waist and torso using belts 153 and 154 in the most comfortable position and thereafter in the manner shown in FIG. 1 and in similarity to the user's application of steadying device 50 shown therein place bow string 24 against curved surface 152 of body 151 thereby providing the steadying action and improving the archer's skill.

What has been shown is a convenient, easy to use and lightweight waist supported bow string steadying device for use by an archer. The device is worn upon the user's belt and is preferably positioned upon the archer's hip to provide a resilient bow string rest surface which may be used to steady the bow at the critical moments prior to arrow launch. Embodiments are shown which provide a fully inflatable waist support as well as other embodiments in which a portion of the steadying device may receive and support various articles for convenient storage. When fully deflated and compacted, the bow string steadying device may be conveniently stored or carried using little or no space and providing little or no weight to the user.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in steadying an archery bow having a bow string, a steadying device comprising:

an outer envelope having an interior cavity, opposed side surfaces, a hip-conforming surface and a front surface;

means for securing said outer envelope to an archer's waist such that said hip-conforming surface generally overlies the archer's hip; and resilient means received within said outer envelope for resiliently supporting said front surface, said steadying device being worn by an archer with said hip-conforming surface proximate the archer's hip such that said front surface extends outwardly and provides a resilient surface against which an archer may press a portion of a drawn bow string to steady a drawn bow and such that said opposed side surfaces extend between said front surface and said hip-conforming surface.

2. A steadying device as set forth in claim 1 wherein said front surface is convexly curved and wherein said lengths of said front surface, said side surfaces and said hip-conforming surfaces are approximately equal.

3. A steadying device as set forth in claim 2 wherein said outer envelope is formed of a flexible fabric.

4. A steadying device as set forth in claim 3 wherein said means for securing includes a pair of belt loops.

5. A steadying device as set forth in claim 4 wherein said resilient means includes size adjusting means for changing the size of said outer envelope to adjustably position said front surface.

6. A steadying device as set forth in claim 5 wherein at least a portion of said outer envelope is formed of a resilient fabric.

7. A steadying device as set forth in claim 3 wherein said resilient means includes:

an inflatable air bladder received within said outer envelope; and inflation means for inflating and deflating said bladder.

8. A steadying device as set forth in claim 7 wherein said air bladder is proximate said front surface and wherein said outer envelope further includes:

an interior cavity distinct from said air bladder; and a recloseable opening for providing access to said interior cavity.

9. A steadying device as set forth in claim 3 wherein said resilient means includes at least one resilient foam member received within said outer envelope.

10. A steadying device as set forth in claim 3 wherein said outer envelope defines a first interior cavity beneath said front surface and a second interior cavity and wherein said resilient means includes a first resilient foam member received within said first interior cavity having a convex front surface and a second generally rectangular resilient foam member received within said second interior cavity.

11. A steadying device as set forth in claim 10 wherein said outer envelope includes a recloseable opening for providing access to said second interior cavity.

12. A steadying device as set forth in claim 3 wherein at least a portion of said flexible fabric is expandable elastic.

13. A steadying device as set forth in claim 12 wherein said resilient means includes:

an inflatable air bladder received within said outer envelope; and inflation means for inflating and deflating said bladder.

14. For use by an archer in steadying a bow having a bow string, a steadying device comprising:

a fabric envelope defining a hip surface, a front surface and a pair of side surfaces having means for support thereof overlying an archer's hip upon said hip surface;

an inflatable bladder received within said envelope; and means for inflating said bladder to expand said envelope to an expanded form in which said side surfaces are approximately equal to said front surface.

15. A steadying device as set forth in claim 14 wherein said means for inflating includes a resilient bulb and valve and a coupling tube.

16. A steadying device as set forth in claim 15 wherein at least a portion of said fabric envelope is formed of a resilient material.

17. For use by an archer in steadying a bow having a bow string, a steadying device comprising:

a solid resilient pad having a generally cylindrical convex front surface, a curved hip surface, a shorter side surface and a longer side surface; and means for supporting said resilient pad upon an archer's hip such that said convex front surface extends outwardly to meet a drawn bow string held by an archer.

* * * * *